US009409043B2

(12) United States Patent
Franken

(10) Patent No.: US 9,409,043 B2
(45) Date of Patent: Aug. 9, 2016

(54) GLASS BREAKING TOOL, METHOD FOR BREAKING GLASS

(75) Inventor: Johannes Baptist Martinus Franken, Zoetermeer (NL)

(73) Assignee: LIFE SAFETY PRODUCTS B.V., Zoetermeer (NL)

( * ) Notice: Subject to any disclaimer, the term of this patent is extended or adjusted under 35 U.S.C. 154(b) by 0 days.

(21) Appl. No.: 13/822,537

(22) PCT Filed: Sep. 9, 2011

(86) PCT No.: PCT/NL2011/050618
§ 371 (c)(1),
(2), (4) Date: May 22, 2013

(87) PCT Pub. No.: WO2012/036548
PCT Pub. Date: Mar. 22, 2012

(65) Prior Publication Data

US 2013/0227795 A1 Sep. 5, 2013

(30) Foreign Application Priority Data

Sep. 13, 2010 (NL) ..... 2005342

(51) Int. Cl.
*B26B 11/00* (2006.01)
*A62B 3/00* (2006.01)

(52) U.S. Cl.
CPC ..... *A62B 3/005* (2013.01); *Y10T 29/4998* (2015.01); *Y10T 225/371* (2015.04)

(58) Field of Classification Search
CPC . A62B 3/005; Y10T 225/371; Y10T 29/4998
USPC ..... 7/158; 81/20
See application file for complete search history.

(56) References Cited

U.S. PATENT DOCUMENTS

| | | | | | |
|---|---|---|---|---|---|
| 947,391 | A | * | 1/1910 | Michael | 30/367 |
| 1,572,046 | A | * | 2/1926 | Seiler | 30/367 |
| 2,787,179 | A | | 4/1957 | Warner | |
| 3,172,204 | A | * | 3/1965 | Frey | 30/367 |
| 3,900,058 | A | * | 8/1975 | McArdle | 81/463 |
| 4,682,412 | A | * | 7/1987 | Pfeffer | 29/750 |
| 5,360,211 | A | * | 11/1994 | Smith et al. | 267/180 |
| 5,657,543 | A | * | 8/1997 | Collins | 30/367 |
| 5,791,056 | A | | 8/1998 | Messina | |
| 6,079,071 | A | | 6/2000 | Sablan et al. | |

(Continued)

FOREIGN PATENT DOCUMENTS

| | | |
|---|---|---|
| CN | 200955930 | 10/2007 |
| DE | 4016612 | 11/1991 |

(Continued)

OTHER PUBLICATIONS

Office Action from the corresponding Chinese Application No. 2011800546284 dated Oct. 20, 2014.

*Primary Examiner* — Hadi Shakeri
*Assistant Examiner* — Danny Hong
(74) *Attorney, Agent, or Firm* — Lucas & Mercanti, LLP

(57) ABSTRACT

A glass breaking tool for breaking a glass pane comprising a head arranged for contact with the glass pane, a handle movable with respect to the head and a pin crusher arranged in the head and handle wherein the tool is adjustable between a rest position in which the pin crusher is locked inside the head, a releasing position in which the pin crusher is released inside the head and a breaking position in which a tip of the pin crusher is at least partially outside the head.

20 Claims, 6 Drawing Sheets

(56) References Cited

U.S. PATENT DOCUMENTS

| | | | | |
|---|---|---|---|---|
| 6,223,441 | B1 | 5/2001 | Parsons | |
| 6,257,093 | B1 * | 7/2001 | Bergacker | 81/20 |
| 6,418,628 | B1 * | 7/2002 | Steingass | 30/367 |
| 6,766,933 | B1 | 7/2004 | Wang | |
| 7,028,874 | B2 * | 4/2006 | Lin | 225/93 |
| 7,557,720 | B2 | 7/2009 | Rubin et al. | |
| 2006/0064822 | A1 | 3/2006 | Wang | |

FOREIGN PATENT DOCUMENTS

| | | | |
|---|---|---|---|
| DE | 202004013455 | | 11/2004 |
| DE | 102004054113 | | 7/2006 |
| DE | 102007049312 | | 4/2009 |
| EP | 1148912 | | 7/2005 |
| GB | 435627 | | 9/1935 |
| GB | 2173237 | | 10/1986 |
| GB | 2263930 | | 8/1993 |
| GB | 2 356 212 | A | 5/2001 |
| GB | 2396651 | | 8/2004 |
| JP | 08216057 | | 8/1996 |
| KR | 20030041399 | | 5/2003 |
| WO | WO 03/041800 | A1 | 5/2003 |
| WO | 2009/030458 | | 3/2009 |

* cited by examiner

GLASS BREAKING TOOL, METHOD FOR BREAKING GLASS

CROSS-REFERENCE TO RELATED APPLICATIONS

This application is a 371 of PCT/NL2011/050618, filed Sept.9, 2011, which claims the benefit of NL Patent Application No. 2005342, filed Sept. 13, 2010, the contents of each of which are incorporated herein by reference.

FIELD OF THE INVENTION

The invention relates to a glass breaking tool.

BACKGROUND OF THE INVENTION

Glass breaking tools are known and widely used for breaking glass, in particular for breaking a glass pane in case of emergency. It can for example be used for breaking a car window or window of a train or tram by a passenger to escape the vehicle in case of emergency. Also, it can be used by a rescue helper for breaking a window of a vehicle rescue victims from the vehicle.

Various glass breaking tools are available. Glass breaking tools such as hammers are known in which the user actively has to break the glass. Also, pretensioned glass breaking tools are known. A pretensioned glass breaking tool is placed by a user against the glass to be broken. The user activates a glass breaking pin crusher by operating a button or a knob or a handle or a housing or any other activating means.

Publication U.S. Pat. No. 6,418,628 describes a spring-loaded glass breaking tool that is adjustable between a ready position, a cocked position, a fire position and a break position. The tool comprises a housing that is slidable over a safety sheath enclosing the pin crusher. An end of the safety sheath is placed against the glass pane. By sliding the housing over the safety sheath, the tool is activated. The pin crusher has in rest a position that is oblique with respect to the longitudinal axis of the tool and has to be aligned before it can move to the break position. In the cocked position, the housing is moved over the safety sheath and the pin crusher is oblique. In the fire position, the pin crusher is aligned by a sleeve ramp of a sleeve arranged inside the safety sheath. When the pin crusher is aligned, it can be pushed to the break position by spring action.

A drawback of this tool is that it may not be reliably since the pin crusher may not be launched when required when the alignment does not occur. Also, the tool may not be safe to use since the pin crusher may be launched unintentionally. Further, due to the four-position adjustment, the tool is rather complex. In addition, it may be difficult to reset the tool from the break position to the ready position to allow multiple uses.

Publication U.S. Pat. No. 5,791,056 describes a spring-loaded glass breaking tool in which the pin crusher is activated by a knob. The knob is movable into the housing and is pretensioned by a spring towards a ready position. By pressing the knob against the spring tension, the tip of the pin crusher is moved outside the housing. Suction caps are placed on the end of the housing that is put against the glass pane.

A drawback of this tool is that it is relatively difficult to operate. A user has to apply a relatively large force on the knob against the spring tension to move the pin crusher such that it breaks the glass. Also, by using suction cups the tool may not be optimally positioned against the glass pane to provide an optimal position for the pin crusher to break the glass.

Publication GB 2 356 212 discloses a glass breaking device, having a spring-loaded, sliding, pointed rod within a housing. In a hand held embodiment, the device would be operated by pressing an end of the device against the glass and applying pressure to a handle of the device, thereby releasing a mechanism rod. In this case, a compressed spring is located just behind the sliding bar, in the distal end of the device, remote from the handle. The handle includes a second spring. The resulting device is relatively bulky (particularly relatively large in a longitudinal direction) and complex.

SUMMARY OF THE INVENTION

An object of the invention is to provide a glass breaking tool that obviates at least one of the above mentioned drawbacks. In particular, an object of the invention is to provide a relatively simple, compact, reliable and safe to use tool.

Thereto, according to a first aspect of the invention provides a glass breaking tool for breaking a glass pane comprising a head arranged for contact with the glass pane comprising a release mechanism for releasing a pin crusher that is movable between an in-position in which a tip of the pin crusher is inside the head and an out-position in which the tip of the pin crusher is at least partly outside the head, a handle movable with respect to the head between a first position in which the handle is basically free from the release mechanism to lock the pin crusher and a second position in which the handle unlocks the release mechanism to release the pin crusher, further comprising an elastic mechanism to pretension the handle to the first position and to move the pin crusher from the in-position to the out-position in the second position of the handle, such that the tool is adjustable between a rest position in which the pin crusher is locked in the in-position, a releasing position in which the pin crusher is released in the in-position and a breaking position in which the pin crusher is in the out-position.

It has been found that the resulting tool can be made relatively simple, compact, durable, reliable and safe to use, compared to prior art devices. By providing a pretensioned tool that is adjustable between a rest position, a releasing position and a breaking position, a relatively simple, easy to use and reliable glass breaking tool is obtained. Due to the three-position adjustability, the tool is relatively simple and straightforward to use. No oblique position of the pin crusher is required, so no alignment of the pin crusher is needed. The pin crusher is in all three positions of the tool according to the invention aligned towards an exit opening of the head. Due to the pretensioning of the elastic mechanism, the user may activate the tool with a relatively modest pushing of the handle from the first position of the handle towards the second position of the handle.

The head is arranged for contact with the glass pane such that a reliable contact is provided and a relatively optimal position for the pin crusher to break the glass pane is obtained.

The handle is movable with respect to the head and can be activated by a user. The user pushes the handle towards the head to operate the release mechanism. The handle is thus pushed from the first position in which the handle is basically free from the release mechanism and in which the pin crusher is locked towards the second position in which the handle unlocks the release mechanism to release the pin crusher.

In an advantageous embodiment, the handle is partly movable inside the head and/or comprises a body member that is movable inside the head. In the first position, the handle extends mainly outside the head, in particular the body member may extend mainly outside the head. In the second position, part of the handle extends inside the head, in particular the body member may extend mainly inside the head. The handle may be provided with a rib that abuts against the head in the second position. In the first position the rib may be positioned at a distance from the head.

In the second position the handle unlocks the release mechanism to release the pin crusher from the release mechanism. The handle may be arranged to open the release mechanism. For example, the release mechanism may comprise a beak that is closed in the first position of the handle to lock the pin crusher and that is opened in the second position of the handle to unlock the pin crusher. By pushing the handle against the legs of the beak, the beak may open and the pin crusher may be unlocked.

Upon unlocking the pin crusher, the elastic mechanism pushes the pin crusher from the in-position towards the out-position. In the in-position, a tip of the pin crusher is inside the head and in the out-position, the tip of the pin crusher is partially outside the head to break the glass. Once the pin crusher is in the out-position and the glass is broken, the elastic mechanism moves the handle back to the first position and the pin crusher is then retracted again to the in-position. The tool is then ready for a next use and can thus be easily used multiple times.

Preferably, the elastic mechanism comprises a spring mechanism. The spring mechanism may be provided with two springs having different spring characteristics. A first spring may be compressed when moving the handle from the first position to the second position, activated by pushing the handle by a user. A second spring may be compressed for (during) moving the pin crusher from the in-position to the out-position, activated by the first spring that relaxes in the second position of the handle. The second spring may be less stiff than the first spring and may move the handle back to the first position and the pin crusher back to the in-position and to adjust the tool from the breaking position to the rest position.

Further, the glass breaking tool may comprise a guide member for guiding the pin crusher towards an exit opening of the head when moving between the in-position and the out-position. The pin crusher can thus be relatively optimally aligned for breaking the glass in the out-position.

In an extra advantageous embodiment the spring mechanism includes a first spring for ejecting the pin crusher, and a second spring for acting between the head and the handle. In that case, preferably, the second spring can be made in once piece with the release mechanism.

The invention further relates to method for breaking a glass pane.

Also, in another aspect of the invention, there is provided a glass breaking tool having a pin crusher, wherein the pin crusher has a crusher element that is made of ceramic material. Preferably, the glass breaking tool at least includes a handle for manually holding the tool, wherein the ceramic crusher element is coupled to the handle.

It has been found that the crusher element that is made of ceramic material (particularly ceramic material having a hardness that is significantly higher than the hardness of glass) can break vehicle windows, for example laminated windows. In a more preferred embodiment, the ceramic crusher element has a sharp tip, for reliably breaking e.g. safety glass (for example of a vehicle front window). Herein, the term "sharp" should be interpreted broadly.

The sharp tip of the ceramic crusher element may e.g. have a conical external surface, extending from a single crusher point (the top of the conus), or a tapered external tip surface, extending from a single crusher line (e.g. a straight line), or a differently shaped tip surface.

In a further embodiment, the pin crusher, having the ceramic material crusher element, is a pin crusher of a tool according to the above-described first aspect of the invention (particularly the tool as described in any of claims 1-12).

However, the pin crusher, having the ceramic material crusher element (i.e. having a ceramic glass breaking tip) can also be applied in other glass breaking tools, for example in a glass breaking tool that does comprise a handle (for holding the tool), and e.g. including a head arranged for contact with the glass pane, the head preferably comprising a release mechanism for releasing the pin crusher (in case the pin crusher is movable between an in-position in which a ceramic tip of the pin crusher is inside the head and an out-position in which the ceramic tip of the pin crusher is at least partly outside the head). In such an embodiment, application of a movable handle and an elastic mechanism to pretension the handle can be entirely optional.

Also, an aspect of the invention provides a method for manufacturing a crusher element of a glass breaking tool, the method including:

manufacturing a crusher element preform utilizing a ceramic material moulding and backing process (e.g. sintering), the preform having a blunt tip; and sharpening the blunt tip into a sharp glass breaking tip.

It has been found that in this manner a desired reliable sharp glass breaking tip of the crusher element can be obtained, in an economical manner. Herein, particularly, the sharp tip is sharper than the blunt tip (a width of the sharp tip e.g. being significantly smaller than a width of the blunt tip, for example by—but not limited to—a factor of at least 5×).

In a preferred embodiment, a plurality of preforms can be moulded at the same time utilizing a single mould, thereby significantly reducing manufacturing costs. To that aim, e.g., there can be provided a mould, including a plurality of mould cavities, for molding the plurality of crusher element preforms.

Further advantageous embodiments are in the dependent claims.

BRIEF DESCRIPTION OF THE DRAWINGS

The inventions will be elucidated further with reference to exemplary embodiments represented in a drawing. In the drawing.

DETAILED DESCRIPTION OF THE INVENTION

Figure 1:
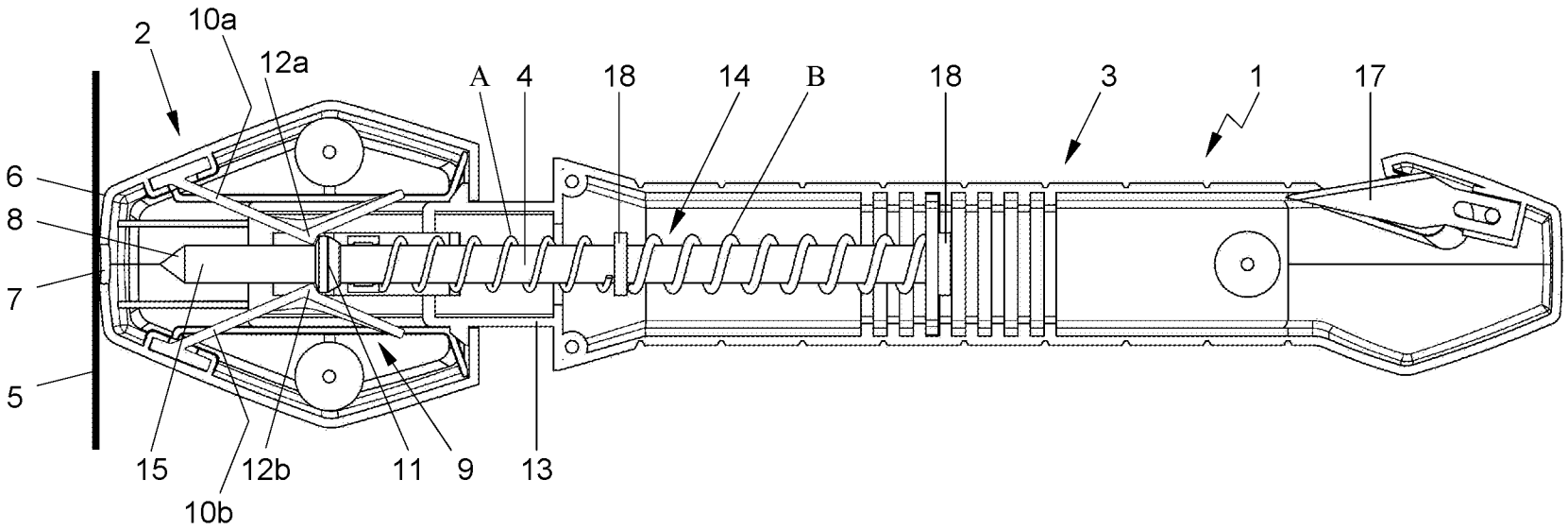
FIG. 1 shows a schematic longitudinal cross section of a first embodiment of a glass breaking tool according to an aspect of the invention in the rest position.

It is noted that the drawings are only diagrammatic and schematic representations of exemplary embodiments of the various aspects of the invention. The embodiments are given by way of non-limiting examples. In the figures, the same or corresponding parts are represented with the same reference numerals.

Figure 4:
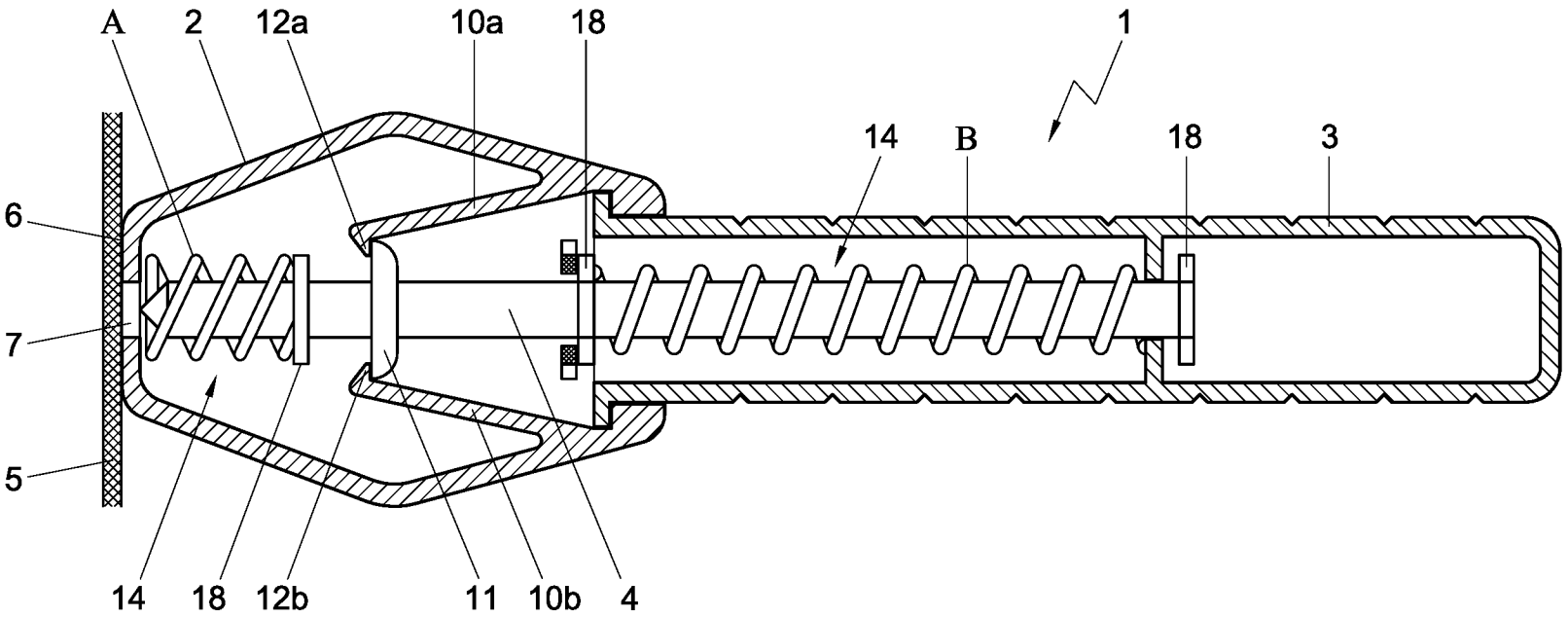
FIG. 4 shows a schematic longitudinal cross section of a second embodiment of a glass breaking tool according to an aspect of the invention.

FIG. 1 shows a schematic longitudinal cross section of a first embodiment of a glass breaking tool 1 according to an aspect of the invention. FIG. 4 shows a schematic longitudinal cross section of a second embodiment of a glass breaking tool 1 according to an aspect of the invention. The glass breaking tool 1 comprises a head 2, a handle 3 and a pin crusher 4. The pin crusher 4 is arranged for breaking a glass pane 5.

The head 2 is arranged for contact with the glass pane 5. Thereto, the head 2 comprises an end surface 6 that at least partially may abut against the glass pane 5. The end surface 6 may for example be provided with ribs or dots or other arrangements for providing the contact with the glass pane 5. Also, the end surface 6 is provided with an opening 7 to allow passage of the pin crusher 4.

Figure 2:
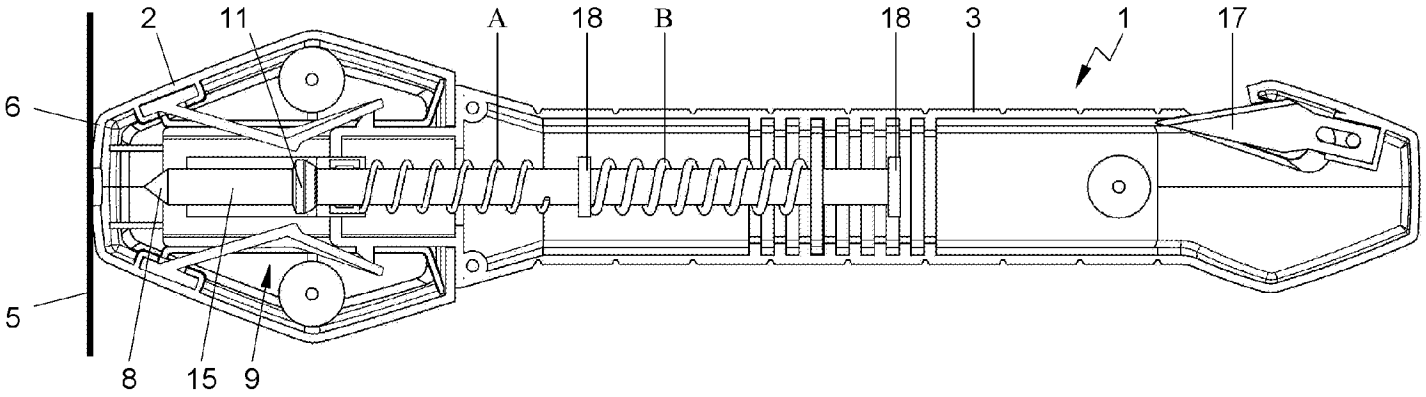
FIG. 2 shows a schematic longitudinal cross section of the glass breaking tool of FIG. 1 in the releasing position.

The pin crusher 4 is movable between an in-position in which a tip 8 of the pin crusher 4 is inside the head 2 and an out-position in which the tip 8 is at least partially outside the head 2. In the out-position the pin crusher 4 is positioned to break the glass 5. In FIG. 1, FIG. 2 and FIG. 4 the pin crusher 4 is in the in-position, in FIG. 3 the pin crusher 4 is in the out-position.

In this embodiment, the head 2 is provided with a release mechanism 9 to lock and release the pin crusher 4. The release mechanism 9 is here arranged as a beak 9 comprising two legs 10*a*, 10*b*. As can be seen in FIG. 1, the legs 10*a*, 10*b* are biased towards each other so the pin crusher 4 can be locked in between. Off course, other release mechanism 9 may be possible. For example, the release mechanism may comprise cams that may lock the pin crusher in an extended position of the cams and that may unlock the pin crusher in a retracted position of the cams. In this embodiment, the pin crusher 4 is provided with a rib 11 that hooks behind the release mechanism 9, here edges 12*a*, 12*b* of the legs 10*a*, 10*b*.

By operating the release mechanism 9, the release mechanism 9 may unlock to release the pin crusher 4. According to an aspect of the invention, the release mechanism 9 is operated by the handle 3.

Figure 3:
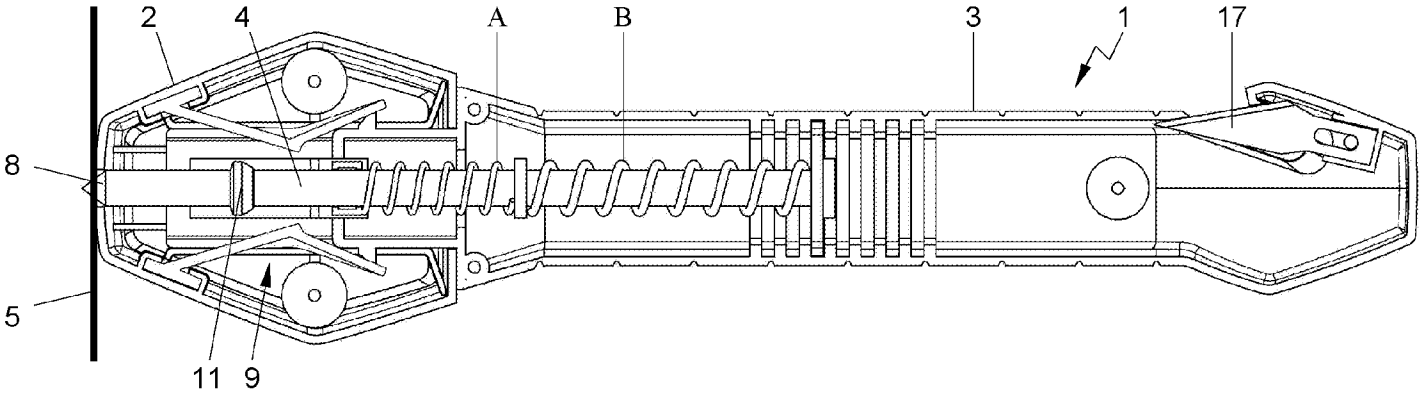
FIG. 3 shows a schematic longitudinal cross section of the glass breaking tool of FIG. 1 in the breaking position.

The handle 3, which serves as an outermost housing, is movable with respect to the head 2. The handle 3 is movable between a first position in which the handle 3 is basically free of the release mechanism 9 and a second position in which the handle 3 activates the release mechanism 9. FIG. 1 and FIG. 4 show the handle 3 in the first position. FIG. 2 and FIG. 3 show the handle 3 in the second position. The handle 3 is movable into the head 2 to operate the release mechanism 9.

In the embodiment shown in FIG. 1-FIG. 3 comprises the handle 3 a body member 13. In the embodiment shown in FIG. 4 is the handle 3 in the first position basically free from the release mechanism 9 while a body member to the handle is omitted.

By moving the handle 3 from the first position to the second position, the handle 3 contacts the legs 10*a*, 10*b* of the beak 9 and pushes the beak 9 open, as can be seen in FIG. 2 and FIG. 3. When the beak 9 is open, the rib 11 of the pin crusher 4 is free from the legs 10*a*, 10*b* and the pin crusher 4 is released from the release mechanism 9. The pin crusher 4 can then be moved from the in-position to the out-position to break the glass 5.

The pin crusher 4 is activated to move from the in-position to the out-position by an elastic mechanism 14. The elastic mechanism 14 comprises in the embodiments shown a spring mechanism with two springs A and B (i.e. a first spring B and a second spring A). The springs A and B are in the embodiments shown arranged around the pin crusher 4. On the pin crusher 4 flanges 18 are mounted to limit the springs A and B. Of course also other arrangements of the springs may be provided. For example, the springs may be arranged approximately parallel to the pin crusher, or the springs may be torsion springs. Instead of springs resilient elements such as rubber elements or compressible inflatable elements such as a bellows may be used.

The spring mechanism 14 pretensions the handle 3 towards the first position of the handle 3. The handle 3 is moved against the spring tension of spring A and spring B from the first position to the second position. In the second position, spring B moves the pin crusher 4 from the in-position to the out-position. Thereafter, spring A moves the pin crusher 4 back from the out-position to the in-position and the handle 3 from the second position to the first position. The springs A and B have different spring characteristics. In this embodiment the spring B is stronger than the spring A. In other embodiments, this may be arranged otherwise.

While the pin crusher 4 moves between the in-position and the out-position, a front part 15 of the pin crusher 4 is guided by the guide member 16 to facilitate the movement of the pin crusher 4 towards the opening 7.

The operation of the glass breaking tool 1 is as follows. The glass breaking tool 1 is in the rest position. In the rest position, the pin crusher 4 is in the in-position locked by the release mechanism 9 and the handle 3 is in the first position free of the release mechanism 9. A user pushes the handle 3 from the first position towards the second position against the spring tension of the elastic mechanism 14. The beak 9 opens and releases the pin crusher 4. The glass breaking tool 1 is in the releasing position. In the releasing position the pin crusher 4 is in the in-position and the handle 3 has moved partly inside the head 2 and is in the second position. The spring B is compressed. Then the spring B relaxes and pushes the pin crusher 4 towards the out-position while the spring A is compressed. The tool 1 is then in the breaking position. In the breaking position, the handle 3 is in the second position and the pin crusher 4 is in the out-position. Then the spring A relaxes and pushes the pin crusher 4 and the handle 3 backward to the in-position and the first position respectively. The tool 1 is then ready to be used again. In a relatively simple way, the tool 1 is thus arranged for multiple uses.

Advantageously, the tool 1 is provided with a cutting member 17 on the handle 3. The cutting member 17 can for example be used for cutting a seat belt in case of emergency.

Figure 5:
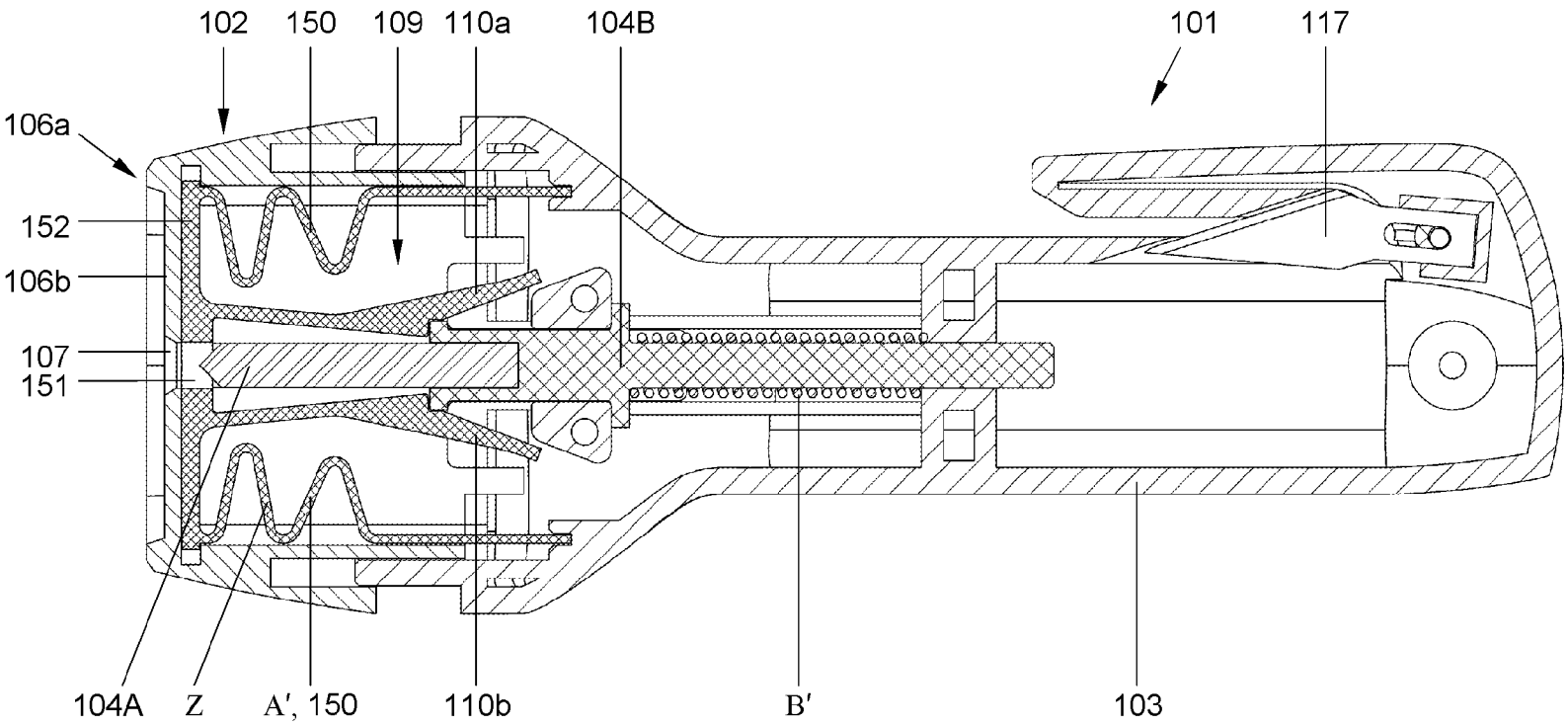
FIG. 5 shows a schematic longitudinal cross section of a glass breaking tool according to a third embodiment of an aspect of the invention in the rest position.
Figure 6:
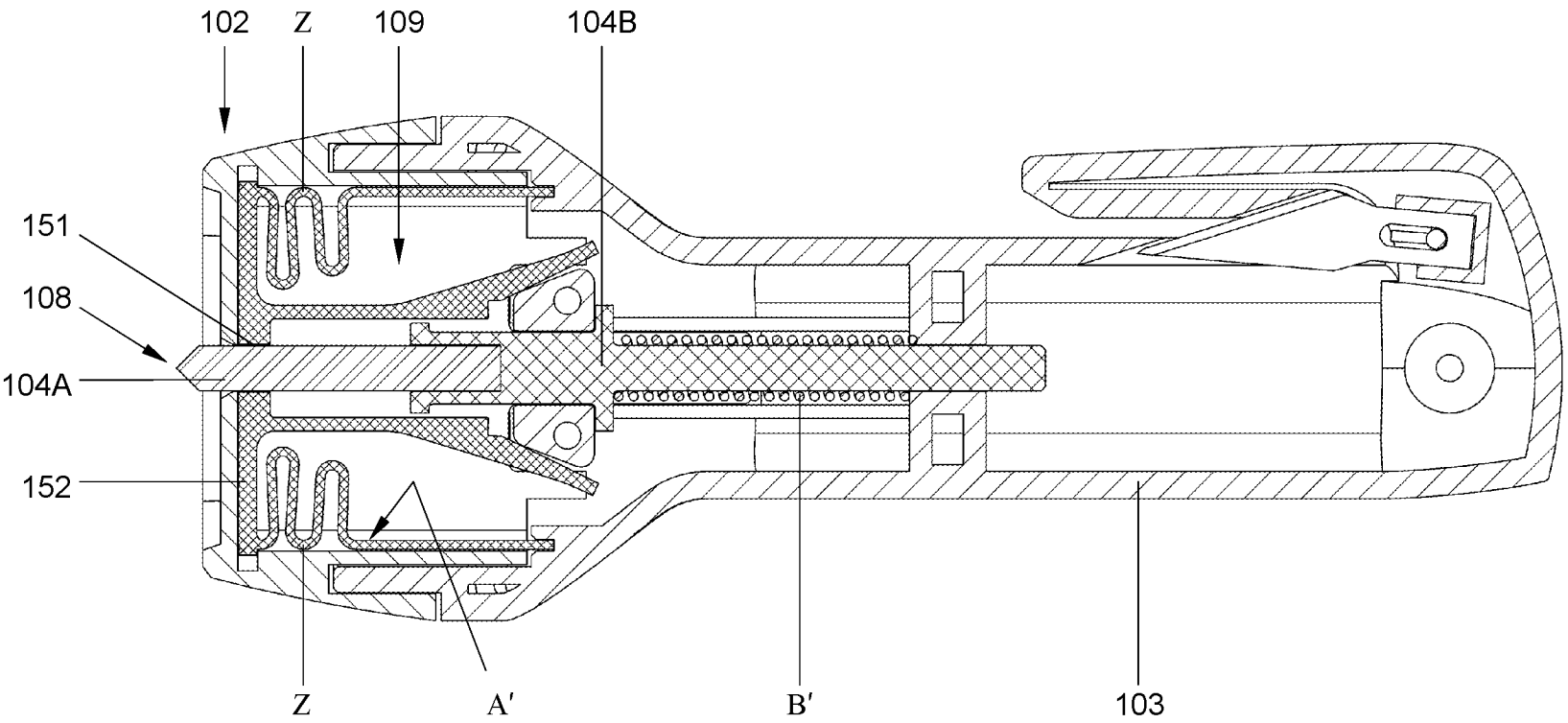
FIG. 6 is similar to FIG. 5, showing the third embodiment in the breaking position.
Figure 7:
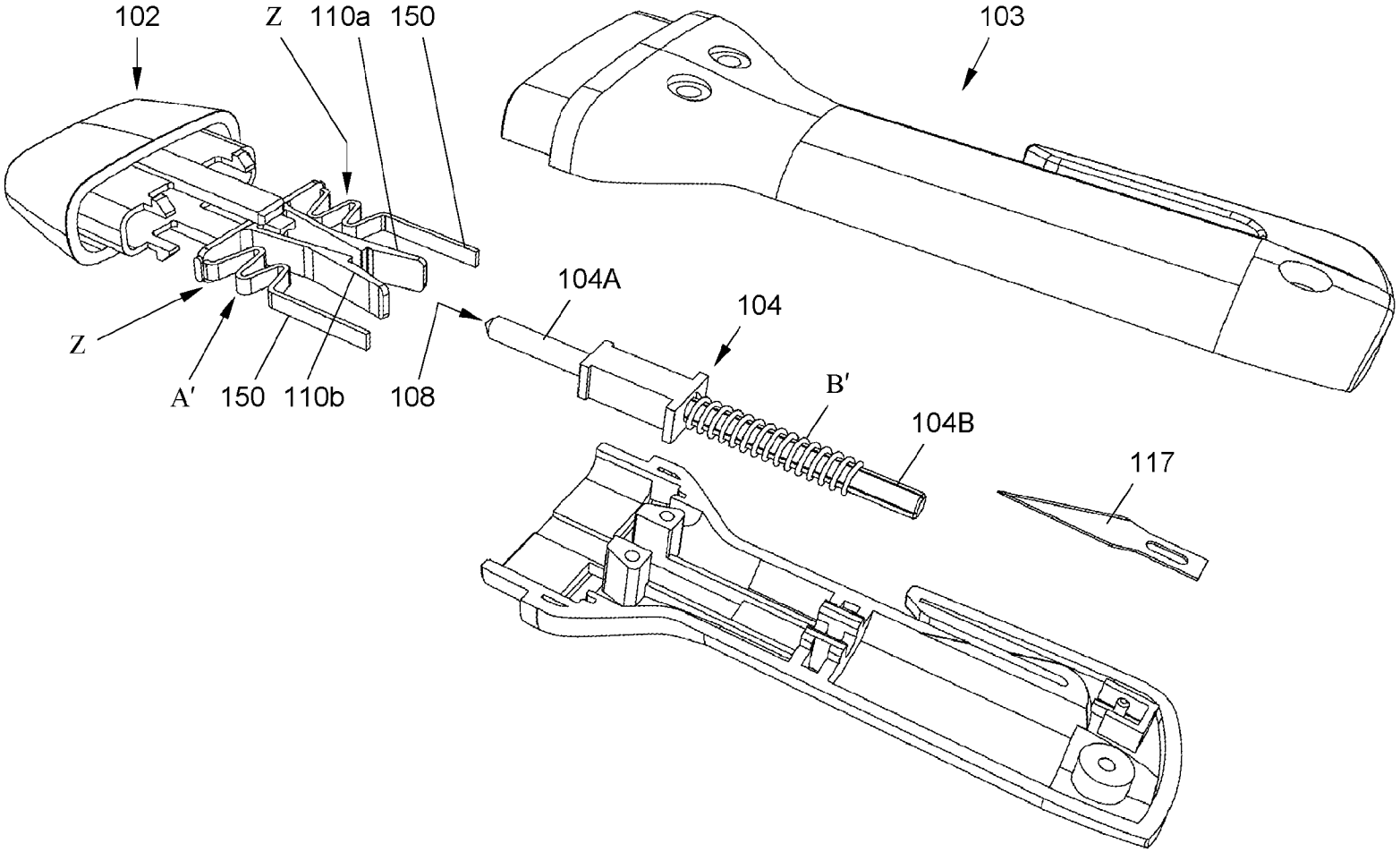
FIG. 7 is an exploded view of the third embodiment.

FIGS. 5-7 show a further, extra advantageous embodiment 101 of the tool. The third embodiment of a glass breaking tool 101 comprises a head 102, a handle 103 (which serves as an outermost housing), a pin crusher 104 and a cutting member 117. The head 102 is arranged for contact with the glass pane 5. Thereto, the head 102 may comprise an end surface defined by a rib 106*a* for providing contact with a glass pane 5 during operation. In the example, the rib 106*a* extends along a perimeter of a recessed front wall 106*b* having an opening 107 to allow passage of a distal part 104A of the pin crusher 104.

In the present example, the pin crusher 104 includes a glass crushing element 4A, providing the distal glass breaking tip 108, and an elongated crushing element holder 4B, reaching from the glass crushing element 4A into the handle 103. As will be explained below, in a further advantageous embodiment, the glass crushing element 4A is made of another material (preferably ceramic material) than a remaining part (4B) of the crusher 104.

As in the embodiments described above, the pin crusher 104 is movable between an in-position (see FIG. 5) in which the tip 108 of the distal section 104A of the crusher 104 is inside the head 102, and an out-position (see FIG. 6) in which the tip 108 is at least partially outside the head 102. Also, in this embodiment, the head 102 is provided with a release mechanism 109 to lock and release the pin crusher, the release mechanism 109 e.g. being arranged as a beak comprising two legs 110*a*, 110*b* (being biased towards each other).

Preferably, as in the first embodiment, the pin crusher 104 is activated to move from the in-position to the out-position by an elastic mechanism, comprising e.g. a first spring B' and a second spring A'. As in the first embodiment, the spring mechanism includes a first spring B' for ejecting the pin crusher, and a second spring A' for resiliently acting between the head and the handle. The present third embodiment differs from the first embodiment in that the second spring A' spring is made in once piece with the release mechanism 109. In this way, complexity is reduced even further, leading to further improvements regarding durability, reliability and manufacturing costs. In a particularly advantageous embodiment, the second spring A' spring is made in once piece with the release mechanism 109 from plastic.

In the present example, the second spring A' includes two spring profiles 150, extending on opposite sides with respect of the pin crusher. First ends of the spring profiles 150 are connected to the handle 103, for example via respective notches or slits. Second ends of the spring profiles 150 are operatively coupled to the head 102. In the example, the second ends of the spring profiles 150 include lateral front legs 152 that abut an inner side of the front wall 106*b* of the head 102.

In the example, each of the spring profiles 150 including a zigzag spring part Z (located between a first and second spring end), providing the (main) spring action of the second spring A' during operation. The zigzag spring part Z as such includes a plurality of straight sections being interconnected by sharp spring leaf bend sections, as will be appreciated by the skilled person (see also the drawings). Each of the spring profiles 150 as such may be a strip-like profile (the strip as such having a rectangular cross-section), as in the embodiment, but that is not required.

The spring profiles 150 can be made in one piece with one another, and with the release legs 110*a*, 110*b*. Also, the spring profiles 150 may define an opening 151 to allow passage of a distal part 104A of the pin crusher 104 (the opening 151 being located behind the head's front opening 107).

Preferably, the spring profiles 150 of the second spring B' are made of a resilient plastic, for example (but not limited to) durable POM (polyoxymethylene).

Operation of the example shown in FIGS. 5-7 corresponds to the operation of the tool shown in FIGS. 1-3.

In another aspect, which aspect can be part of the embodiments described here-above, the glass breaking tool includes a pin crusher having a crusher element that is made of ceramic material. The ceramic material may e.g. be (sintered, crystalline) aluminium oxide ceramic, silicon carbide or tungsten carbide, or another ceramic. A Knoop hardness (following the ASTM D 1474 standard) of the ceramic used can e.g. be at least 600 or higher, e.g at least 900 or higher (and can therefore be is significantly higher than the Knoop hardness of steel, which is lower than 200).

Referring to FIGS. 5-7, as an example, there can be provided a glass breaking tool, having a relatively hard ceramic crushing element 104A.

In that case, preferably, a remaining part 104B of the crusher 104 can be made of another material, for example plastic. The ceramic part 104A can be connected to the other (proximal) part 104B in various ways, for example using an adhesive.

In a further advantageous embodiment, the distal section that is made of ceramic material is a pin 104A, having a sharp tip (e.g. point) 108. In the example, the pin 104A has a substantially cylindrical shape, with a tip 108 that extends towards a single glass breaking point, the tip having a conical external surface. As has been mentioned before, the tip can also be shaped differently.

It has been found that such a ceramic crusher tip can be made utilizing a sharpening process, particularly after an initial ceramic moulding and backing process. The process may involve:

- a first step of manufacturing a crusher element preform utilizing a ceramic moulding and backing process (particularly ceramic sintering), the preform having a blunt tip; and
- a second step of sharpening the blunt tip into a sharp glass breaking tip.

Then, preferably, the first step is carried out by moulding (and subsequently backing) a plurality of preforms at the same time utilizing a single mould. The sharpening step can e.g. be achieved using diamond sharpening means (e.g. including abrasive/grinding diamond surfaces), known as such to the skilled person.

In this way, there are provided significant improvements over conventional glass breaking tools. It has been found that a glass breaking pin 104A having a sharp tip can be stored safely within the tool before use, to be automatically activated (i.e. moved towards the out-position) during a glass breaking action. The sharp ceramincs tip 108 can break strong glass reliably. Also, the ceramic tip 108 will not loose sharpness during operation, to be used iteratively in a reliable manner.

Many variants will be clear to the person skilled in the art and are understood to fall within the scope of the invention as set forth in the appended claims.

The invention claimed is:

1. A glass breaking tool for breaking a glass pane comprising

- a head adapted to be pressed against the glass pane to be broken, the head having an end surface to at least partially abut the glass pane where the end surface includes an opening sized to allow movement of a pin crusher disposed within the head, the head having disposed therein a release mechanism for releasing the pin crusher that is movable between an in-position in which a tip of the pin crusher is inside the head and an out-position in which the tip of the pin crusher is at least partly outside the head by extending past the end surface;
- an outermost housing that serves as a handle, the outermost housing movable with respect to the head between a first position in which the outermost housing is basically free from the release mechanism to lock the pin crusher in the in-position and a second position in which the outermost housing is adapted to unlock the release mechanism to release the pin crusher to move to the out-position; further comprising
- an elastic mechanism to pretension the outermost housing to the first position and to move the pin crusher from the in-position to the out-position in the second position of the outermost housing when the release mechanism is unlocked,
- wherein the tool is adjustable between a rest position in which the pin crusher is locked in the in-position, a releasing position in which the pin crusher is released from the in-position, and a breaking position in which the pin crusher is in the out-position whereby the tip of the pin crusher extends past the end surface, and wherein the release mechanism further comprises a beak that is opened by the outermost housing when the outermost housing is in the second position.

2. A glass breaking tool for breaking a glass pane comprising a head adapted to be pressed against the glass pane to be broken, the head having an end surface to at least partially about the glass pane where the end surface includes an opening sized to allow movement of a pin crusher disposed within the head, the head having disposed therein a release mechanism for releasing the a pin crusher that is movable between an in-position in which a tip of the pin crusher is inside the head and an out-position in which the tip of the pin crusher is at least partly outside the head by extending past the end surface;

an outermost housing that serves as a handle, the outermost housing movable with respect to the head between a first position in which the outermost housing is basically free from the release mechanism to lock the pin crusher in the in-position and a second position in which the outermost housing is adapted to unlock the release mechanism to release the pin crusher to move to the out-position; further comprising an elastic mechanism to pretension the outermost housing to the first position and to move the pin crusher from the in-position to the out-position in the second position of the outermost housing when the release mechanism is unlocked, wherein the tool is adjustable between a rest position in which the pin crusher is locked in the in-position, a releasing position in which the pin crusher is released from the in-position, and a breaking position in which the pin crusher is in the out-position whereby the tip of the pin crusher extends past the end surface, and wherein the outermost housing is partly movable inside the head.

3. The glass breaking tool according to claim 1, wherein the outermost housing further comprises a body member that is movable inside the head.

4. The glass breaking tool according to claim 3, wherein the body member unlocks the release mechanism when the outermost housing is in the second position.

5. The glass breaking tool according to claim 2, wherein the release mechanism further comprises a beak that is opened by the outermost housing when the outermost housing is in the second position.

6. The glass breaking tool according to claim 1, further comprising a guide member for guiding the pin crusher between the in-position and the out-position.

7. The glass breaking tool according to claim 1, wherein the elastic mechanism comprises a spring mechanism.

8. The glass breaking tool according to claim 7, wherein the spring mechanism comprises two springs having different spring characteristics.

9. The glass breaking tool according to claim 7, wherein the spring mechanism includes a first spring for ejecting the pin crusher, and a second spring for resiliently acting between the head and the outermost housing.

10. The glass breaking tool according to claim 9, wherein the second spring is made in one piece with the release mechanism.

11. The glass breaking tool according to claim 9, wherein the second spring is made of a resilient plastic.

12. The glass breaking tool according to claim 9, wherein the second spring includes two spring profiles, extending on opposite sides with respect of the pin crusher, first ends of the spring profiles being connected to the outermost housing and second ends of the spring profiles being operatively coupled to the head, each of the spring profiles including a zigzag spring part.

13. The glass breaking tool according to claim 1, wherein the pin crusher has a crusher element that is made of ceramic material.

14. The glass breaking tool according to claim 13, wherein the crusher element has a sharp glass crushing tip.

15. The glass breaking tool according to claim 1, further comprising a cutting member arranged on the outermost housing.

16. The glass breaking tool according to claim 9, wherein the second spring is made of a POM (polyoxymethylene).

17. The glass breaking tool according to claim 2, further comprising a guide member for guiding the pin crusher between the in-position and the out-position.

18. The glass breaking tool according to claim 2, wherein the elastic mechanism comprises a spring mechanism.

19. The glass breaking tool according to claim 2, wherein the pin crusher has a crusher element that is made of ceramic material.

20. The glass breaking tool according to claim 2, further comprising a cutting member arranged on the outermost housing.

* * * * *